US011725443B2

(12) United States Patent
Gunn et al.

(10) Patent No.: US 11,725,443 B2
(45) Date of Patent: Aug. 15, 2023

(54) LINEAR HINGE ASSEMBLY FOR AN APPLIANCE

(71) Applicant: Haier US Appliance Solutions, Inc., Wilmington, DE (US)

(72) Inventors: Tanner Davis Gunn, Louisville, KY (US); Bart Andrew Nuss, Fisherville, KY (US); Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 143 days.

(21) Appl. No.: 17/113,319

(22) Filed: Dec. 7, 2020

(65) Prior Publication Data

US 2022/0178187 A1 Jun. 9, 2022

(51) Int. Cl.
*E05D 7/00* (2006.01)
*E05D 3/06* (2006.01)
(Continued)

(52) U.S. Cl.
CPC ..... *E05D 15/581* (2013.01); *E05D 3/14* (2013.01); *F25D 23/028* (2013.01);
(Continued)

(58) Field of Classification Search
CPC ..... Y10T 16/545; Y10T 16/5453; Y10T 16/5457; Y10T 16/547; Y10T 16/6298; Y10T 16/551; Y10T 16/544; Y10T 16/5445; Y10T 16/5448; Y10T 16/5323; E05Y 2900/31; E05Y 2900/148; E05Y 2800/696; E05Y 2201/628; E05Y 2201/638; E05Y 2201/686; E05Y 2201/716; E05D 3/15; E05D 15/30; E05D 15/406; E05D 15/408; E05D 15/42;
(Continued)

(56) References Cited

U.S. PATENT DOCUMENTS 4,827,569 A * 5/1989 Mertes ..... E05D 3/18 16/302
5,040,857 A * 8/1991 Mandel ..... E05D 3/022 312/405

(Continued)

FOREIGN PATENT DOCUMENTS

EP 2712995 A1 4/2014
KR 101972539 B1 8/2019

*Primary Examiner* — Chuck Y Mah
(74) *Attorney, Agent, or Firm* — Dority & Manning, P.A.

(57) ABSTRACT

A domestic appliance may include a cabinet, a door, and a linear hinge coupling the door to the cabinet. The linear hinge may include a bearing assembly, an elongated shaft, a door linkage, and a cabinet linkage. The bearing assembly may be mounted to the cabinet. The elongated shaft may be received within the bearing assembly and slidable along a translation axis on the bearing assembly. The elongated shaft may define a first shaft pivot axis perpendicular to the translation axis and a second shaft pivot axis parallel to the first shaft pivot axis. The door linkage may couple the door to the elongated shaft. The door linkage may be pivotally connected to the elongated shaft at the first shaft pivot axis. The cabinet linkage may couple the cabinet to the elongated shaft. The cabinet linkage may be pivotally connected to the elongated shaft at the second shaft pivot axis.

20 Claims, 11 Drawing Sheets

(51) Int. Cl.
*E05D 15/58* (2006.01)
*E05D 3/14* (2006.01)
*F25D 23/02* (2006.01)

(52) U.S. Cl.
CPC ... *E05Y 2201/626* (2013.01); *E05Y 2201/638* (2013.01); *E05Y 2201/686* (2013.01); *E05Y 2201/716* (2013.01); *E05Y 2900/31* (2013.01)

(58) Field of Classification Search
CPC ..... E05D 15/44; E05D 15/16; E05D 15/165; E05D 15/581; E05D 15/58; E05D 3/18; E05D 13/08; E05D 13/10; F25D 23/028; E05F 11/00; E05F 11/34
See application file for complete search history.

(56) References Cited

U.S. PATENT DOCUMENTS 7,240,397 B2 * 7/2007 Han ..... F25D 23/028 16/273
8,226,183 B2 7/2012 Kang et al.
8,474,103 B2 * 7/2013 Lee ..... E05D 15/582 16/370
9,157,262 B2 * 10/2015 Lee ..... E05D 3/12
10,563,904 B2 2/2020 Kim et al.
10,822,852 B1 * 11/2020 Nuss ..... E05F 1/1253
10,845,116 B2 * 11/2020 Hunter ..... E05D 11/06
2008/0168618 A1 * 7/2008 Hottmann ..... E05F 1/1253 16/50
2013/0221825 A1 * 8/2013 Bonomie ..... F25D 23/02 16/303
2016/0195325 A1 * 7/2016 Kim ..... E05D 11/0054 312/405
2018/0148962 A1 * 5/2018 Jung ..... E05D 11/06
2018/0187956 A1 * 7/2018 Kim ..... F25D 23/02
2018/0230729 A1 * 8/2018 Gherardi ..... E05D 3/122
2020/0217115 A1 * 7/2020 Nuss ..... F25D 23/028
2020/0332578 A1 * 10/2020 Schneider ..... E05D 5/046
2021/0277693 A1 * 9/2021 Güzeltepe ..... E05D 7/0407
2022/0057133 A1 * 2/2022 Oh ..... F25D 23/028

* cited by examiner

LINEAR HINGE ASSEMBLY FOR AN APPLIANCE

FIELD OF THE INVENTION

The present disclosure relates generally to refrigerator appliances, and more particularly, to linear hinges for refrigerator appliances.

BACKGROUND OF THE INVENTION

Refrigerator appliances generally include a cabinet that defines a chilled chamber for receipt of food articles for storage. In addition, refrigerator appliances include one or more doors rotatably hinged to the cabinet to permit selective access to food items stored in chilled chamber(s). The refrigerator appliances can also include various storage components mounted within the chilled chamber and designed to facilitate storage of food items therein. Such storage components can include racks, bins, shelves, or drawers that receive food items and assist with organizing and arranging of such food items within the chilled chamber.

Refrigerator appliances are commonly positioned within a recess in a row of cabinets mounted to a wall in a kitchen. In order to improve the appearance of the refrigerator appliance and minimize protrusion into kitchen walkways, certain refrigerator appliances are designed to be flush mount, where the front of the appliance door sits substantially flush with a front of the cabinets when the doors are closed. In addition, such refrigerators may be designed for receiving a cabinet panel, such that the front appearance of the refrigerator appliance matches the appearance of the cabinetry. However, conventional refrigerator appliances include doors that pivot around a single pivoting axis or hinge, which may cause the door or the panel mounted thereon to rub or conflict with adjacent cabinetry. In addition, refrigerator doors may frequently experience gasket rub or wear as the door is opened and closed repeatedly.

Accordingly, a refrigerator appliance with an improved hinge assembly would be useful. More particularly, a hinge assembly that reduces the likelihood of contact between the refrigerator door and adjacent cabinetry would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a domestic appliance is provided. The domestic appliance may include a cabinet, a door, and a linear hinge coupling the door to the cabinet. The linear hinge may include a bearing assembly, an elongated shaft, a door linkage, and a cabinet linkage. The bearing assembly may be mounted to the cabinet. The elongated shaft may be received within the bearing assembly such that the elongated shaft is slidable along a translation axis on the bearing assembly. The elongated shaft may define a first shaft pivot axis perpendicular to the translation axis and a second shaft pivot axis parallel to the first shaft pivot axis. The door linkage may couple the door to the elongated shaft. The door linkage may be pivotally connected to the elongated shaft at the first shaft pivot axis. The cabinet linkage may couple the cabinet to the elongated shaft. The cabinet linkage may be pivotally connected to the elongated shaft at the second shaft pivot axis.

In another exemplary aspect of the present disclosure, a refrigerator appliance is provided. The refrigerator appliance may include a cabinet, a door, and a linear hinge coupling the door to the cabinet. The linear hinge may include a bearing assembly, an elongated shaft, a door linkage, a cabinet linkage, and an offset link. The bearing assembly may be mounted to the cabinet. The elongated shaft may be received within the bearing assembly such that the elongated shaft is slidable along a translation axis on the bearing assembly. The elongated shaft may define a first shaft pivot axis, a second shaft pivot axis, and a third shaft pivot axis. The first shaft pivot axis may be perpendicular to the translation axis. The second and third shaft pivot axes may be parallel to the first shaft pivot axis. The door linkage may couple the door to the elongated shaft. The door linkage may be pivotally connected to the elongated shaft at the first shaft pivot axis. The cabinet linkage may couple the cabinet to the elongated shaft. The cabinet linkage may be pivotally connected to the elongated shaft at the second shaft pivot axis. The offset link may be pivotally connected to the elongated shaft at the third shaft pivot axis and to the door at a door pivot axis.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
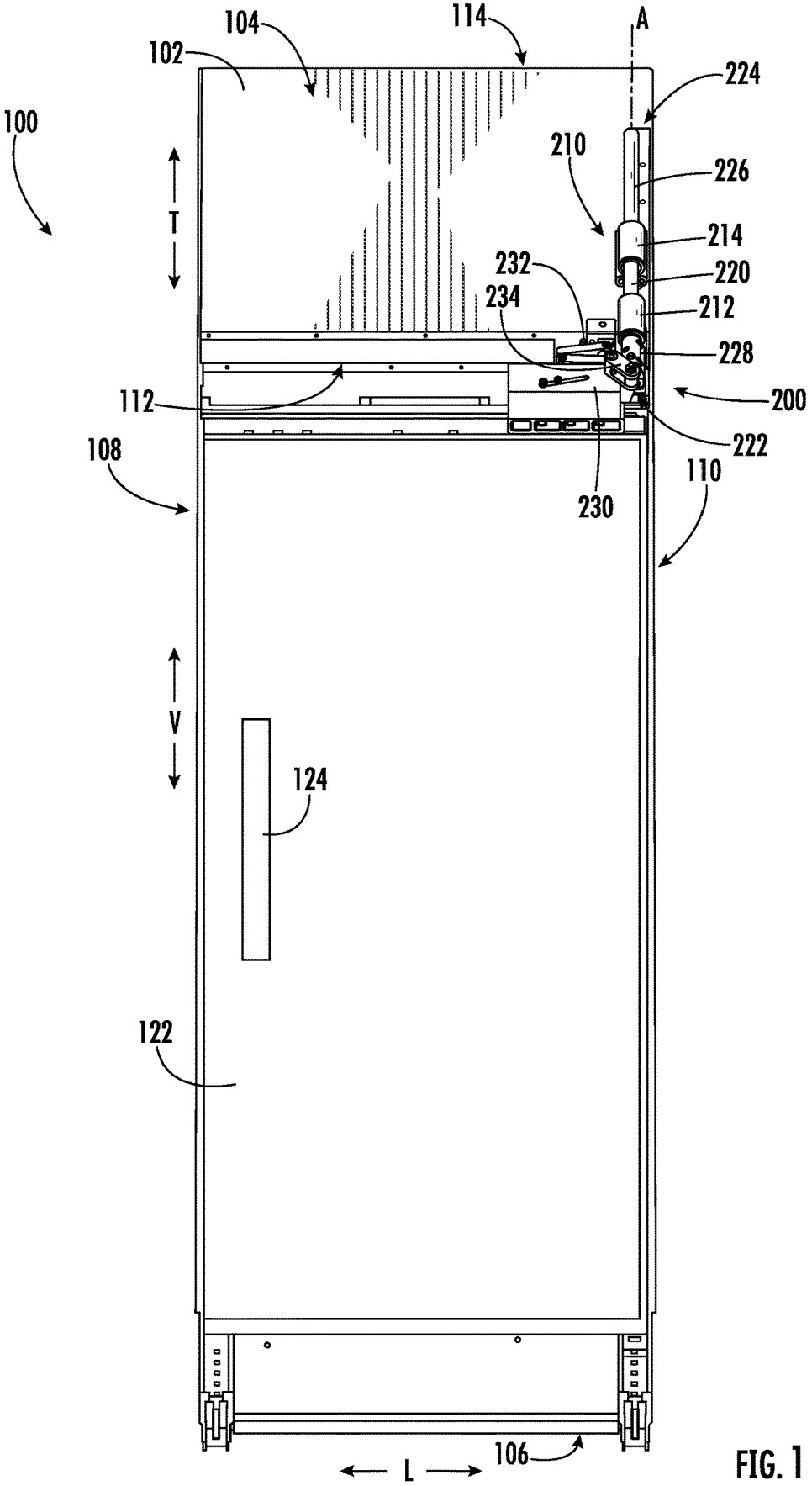
FIG. 1 provides a top perspective view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

FIG. 1 is a perspective view of an appliance 100, such as a refrigerator appliance, according to exemplary embodiments of the present disclosure. As may be seen in FIG. 1, appliance 100 includes a housing or cabinet 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Cabinet 102 generally defines one or more chilled chambers 120 for receipt of food items for storage. Cabinet 102 may be insulated and refrigerator appliance 100 may further include a sealed system (not shown) that is operable to cool chilled chamber 120 and food items stored therein. Although refrigerator appliance 100 is illustrated as a single compartment refrigerator, it should be appreciated that aspects of the present disclosure may be applied to other types of refrigerator appliances, such as bottom mount, top mount, and side-by-side refrigerator appliances. Moreover, aspects of the present disclosure may be used for any other suitable appliance that includes a rotating door. For example, aspects of the present disclosure may be used in or with French door oven appliances, dishwasher appliances, etc. to mount a door to a cabinet, such as a base, a tub, etc.

Referring still to FIG. 1, a door 122 is coupled to cabinet 102 with one or more linear hinge assemblies 200 (e.g., located at a top and a bottom of door 122). A user may rotate door 122 open to access and interior of cabinet 102 (e.g., chilled chamber 120), and the user may rotate door 122 closed to seal the interior of cabinet 102. Door 122 may also include a handle 124 that a user may pull when opening and closing door 122. Linear hinge assemblies 200 will be described herein in more detail according to exemplary embodiments of the present disclosure. In general, linear hinges are used to allow doors to translate away from adjacent cabinetry or appliances in addition to rotating open and closed. By translating in addition to rotating, interference between the doors and the adjacent cabinetry or the appliance itself can be avoided.

Figure 2:
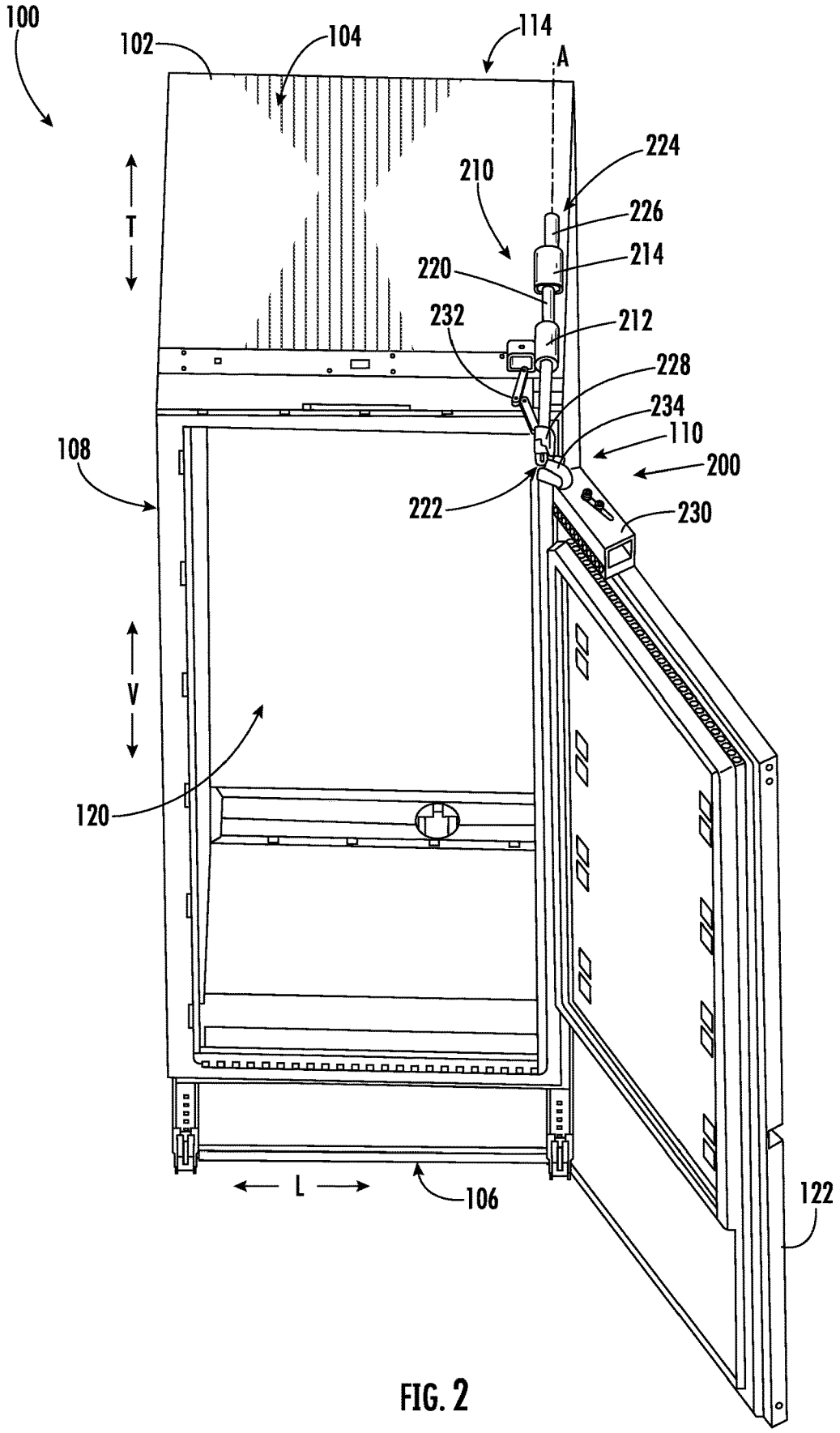
FIG. 2 provides a top perspective view of the exemplary refrigerator appliance of FIG. 1, wherein the door is an open position.
Figure 3:
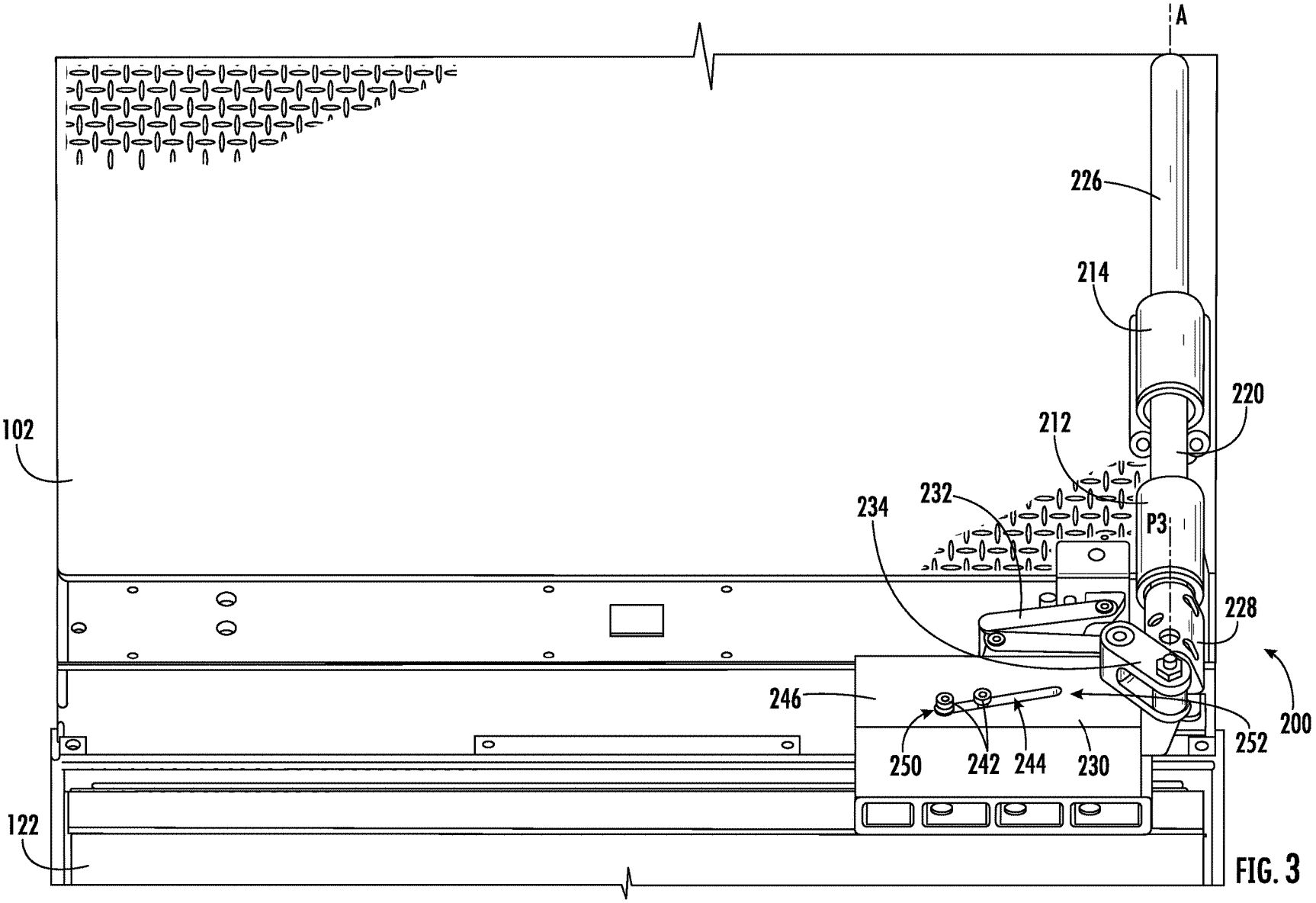
FIG. 3 provides a magnified perspective view of a portion of the linear hinge assembly of the exemplary refrigerator appliance of FIG. 1.
Figure 4:
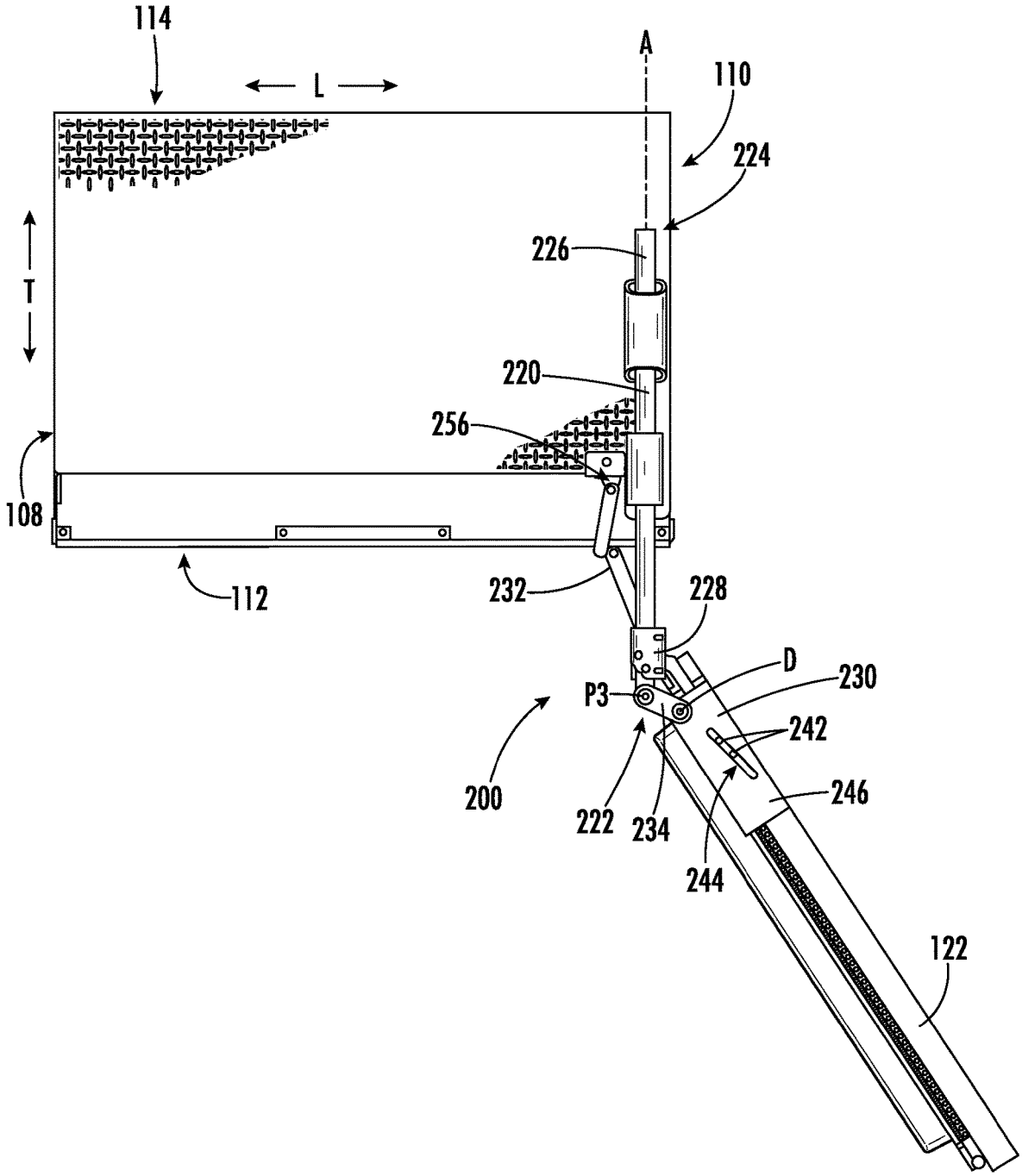
FIG. 4 provides a top plan view of a portion of the exemplary refrigerator appliance of FIG. 1, wherein the door is an open position FIG. 5 provides a top perspective view of a portion of the linear hinge assembly of the exemplary refrigerator appliance of FIG. 1.
Figure 5:
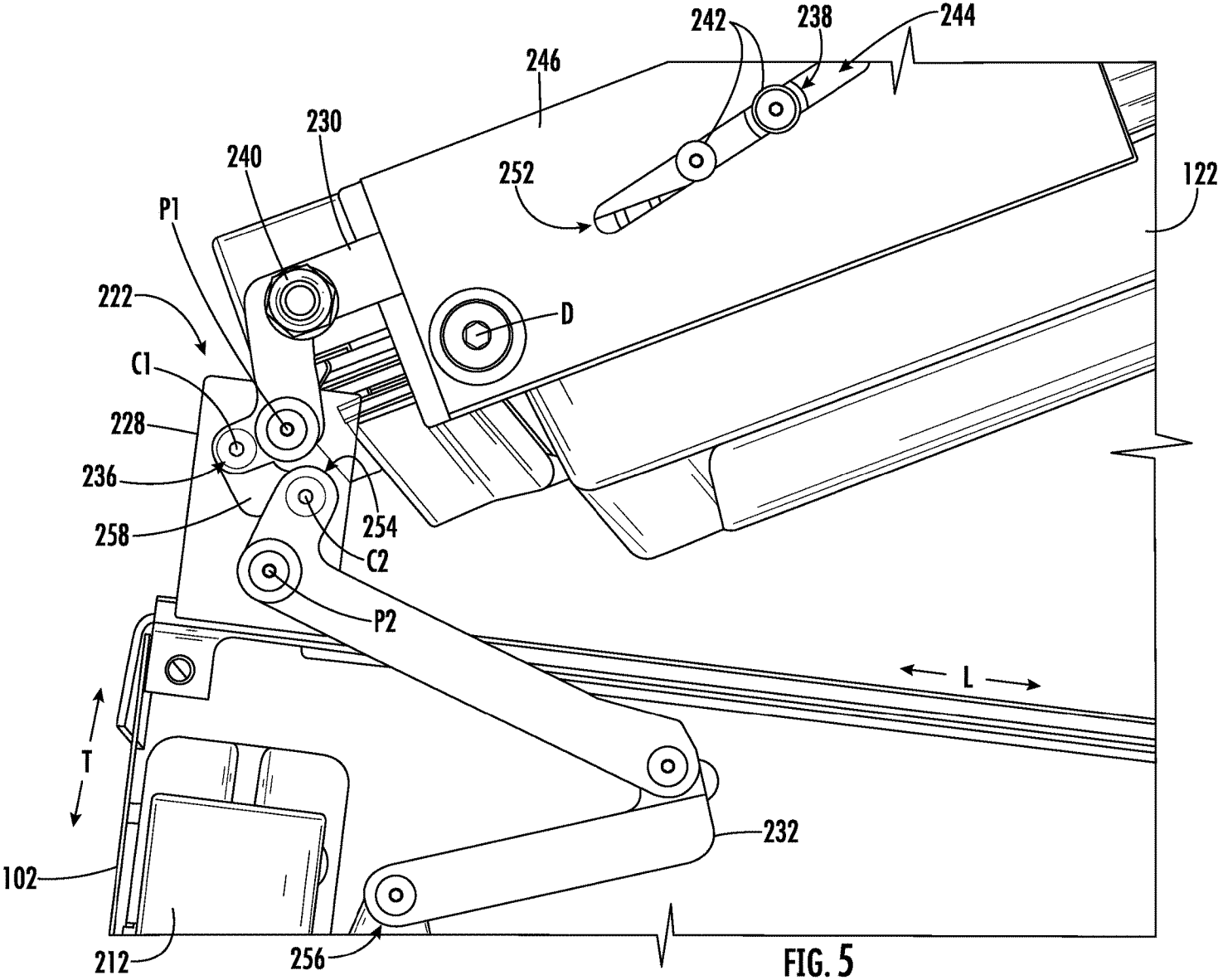
Figure 6:
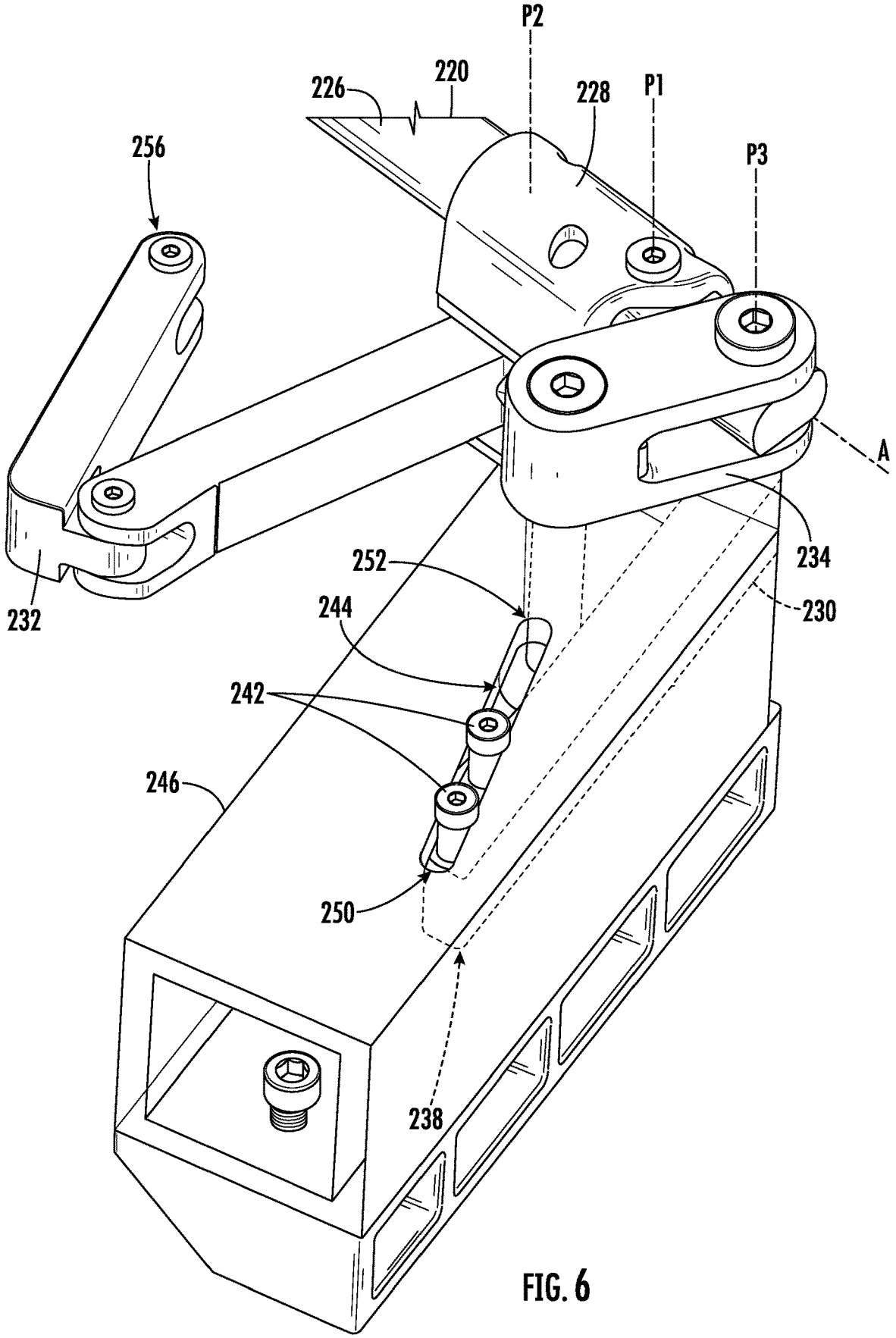
FIG. 6 provides a front perspective view of a portion of the linear hinge assembly of the exemplary refrigerator appliance of FIG. 1.
Figure 7:
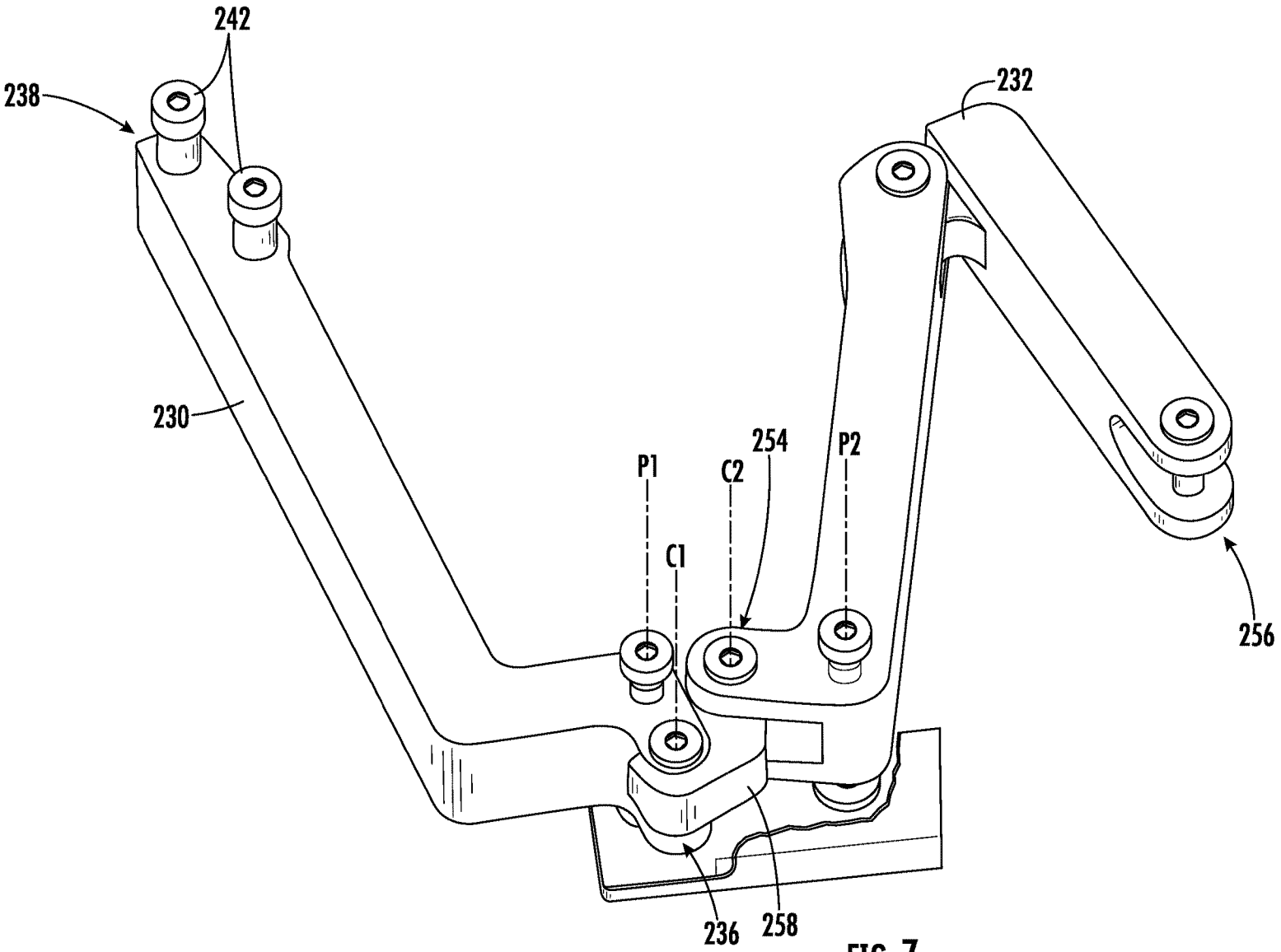
FIG. 7 provides a front perspective view of a portion of the linear hinge assembly of the exemplary refrigerator appliance of FIG. 1.
Figure 8:
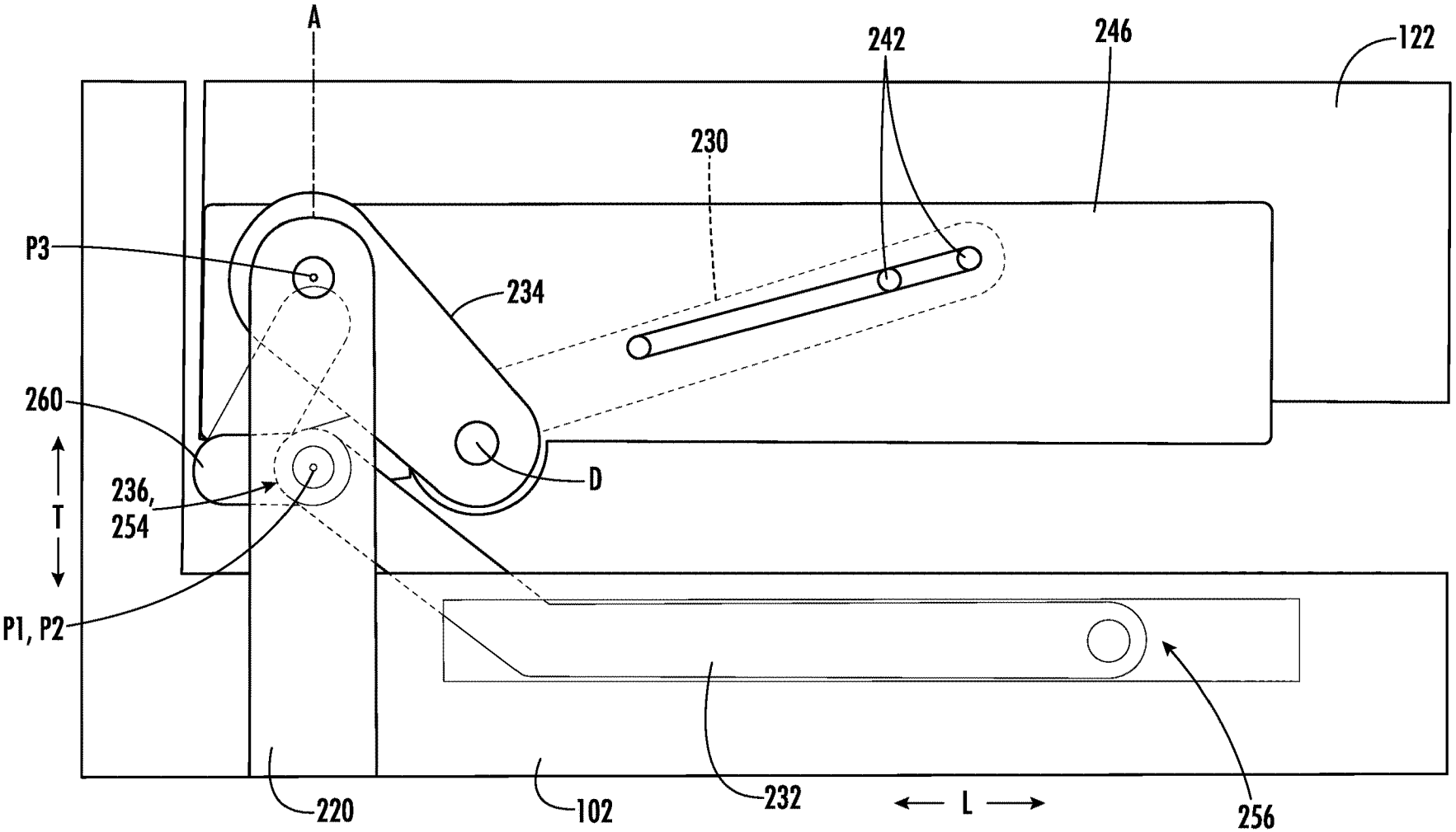
FIG. 8 provides a top plan view of a linear hinge assembly of a refrigerator appliance according to exemplary embodiments of the present disclosure, wherein a door is in a closed position.
Figure 9:
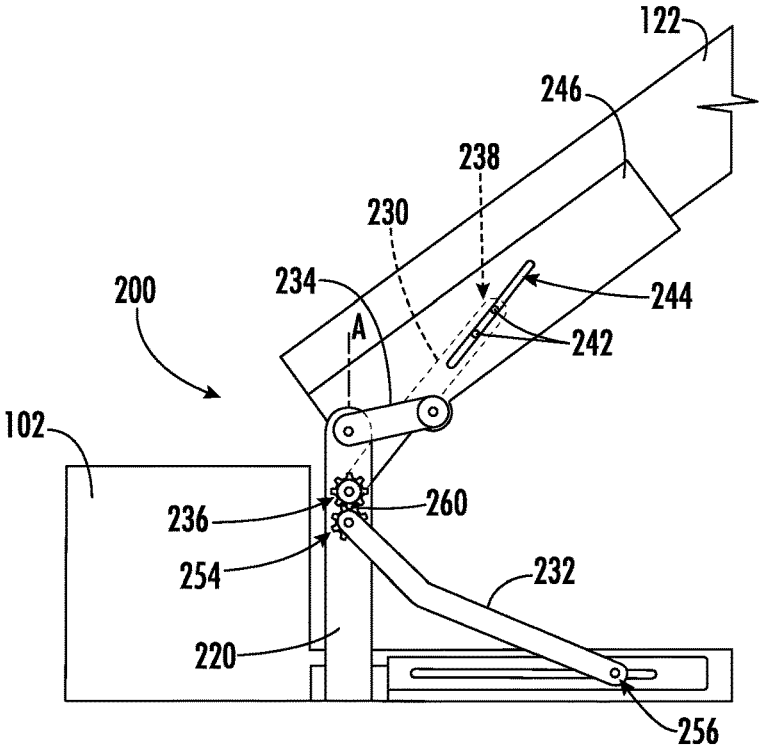
FIG. 9 provides a top plan view of a linear hinge assembly of a refrigerator appliance according to exemplary embodiments of the present disclosure, wherein the door is in an intermediate position.
Figure 10:
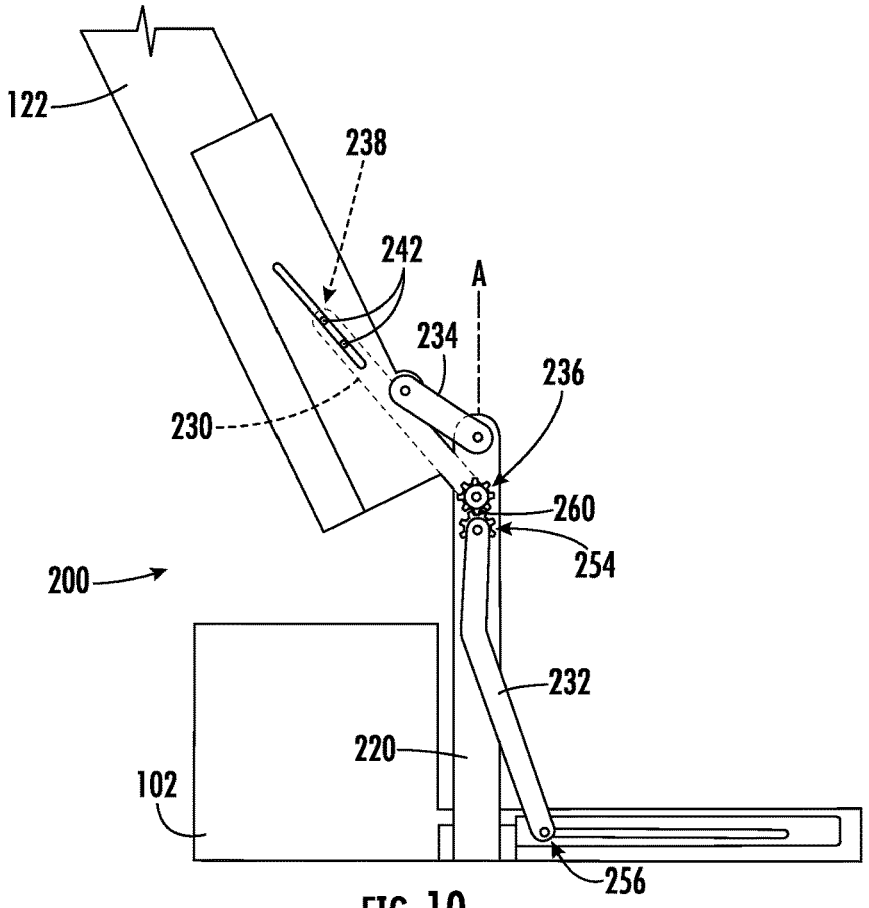
FIG. 10 provides a top plan view of the exemplary linear hinge of FIG. 9, wherein the door is in an open position.
Figure 11:
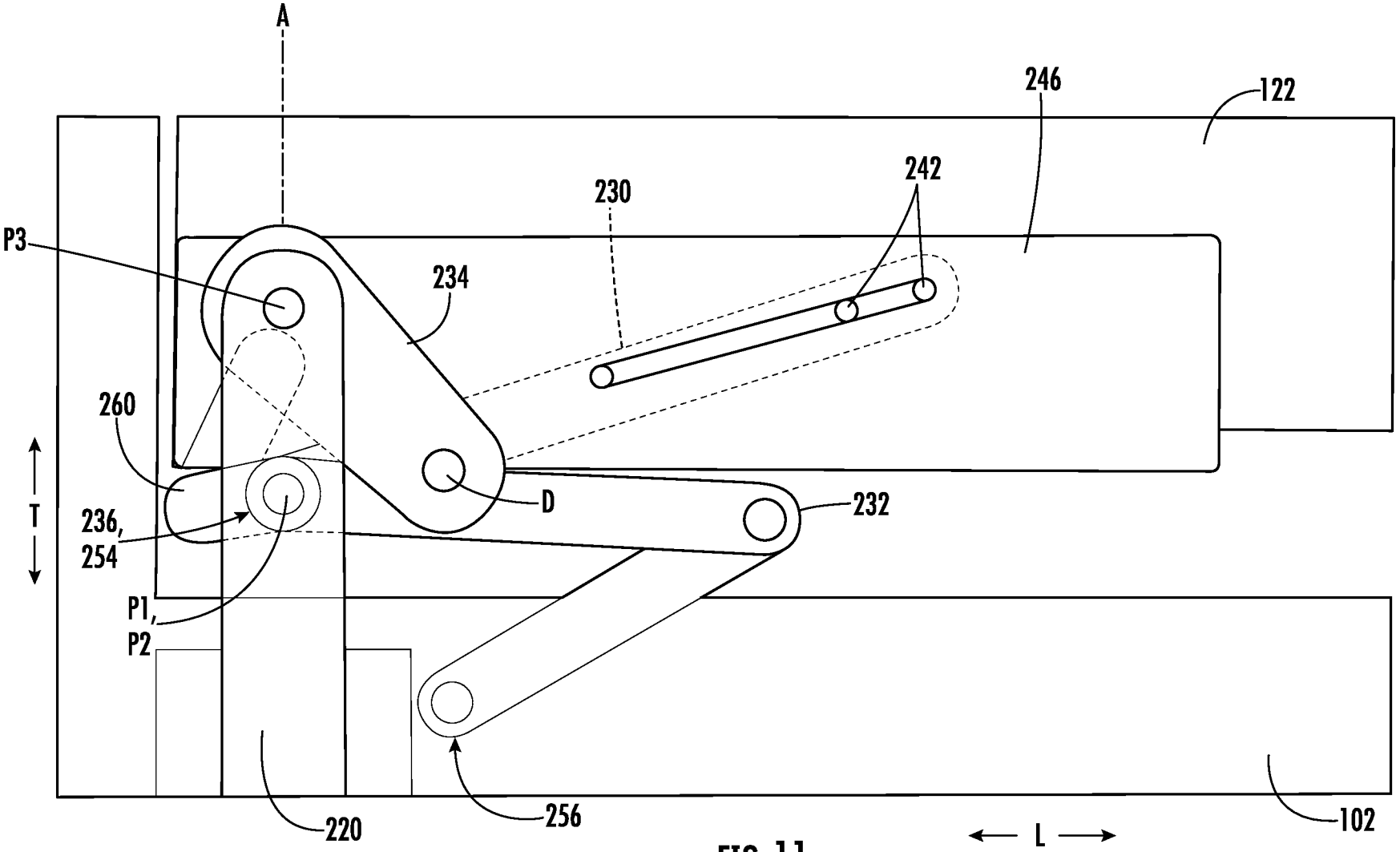
FIG. 11 provides a top plan view of a linear hinge assembly of a refrigerator appliance according to exemplary embodiments of the present disclosure, wherein a door is in a closed position.
Figure 12:
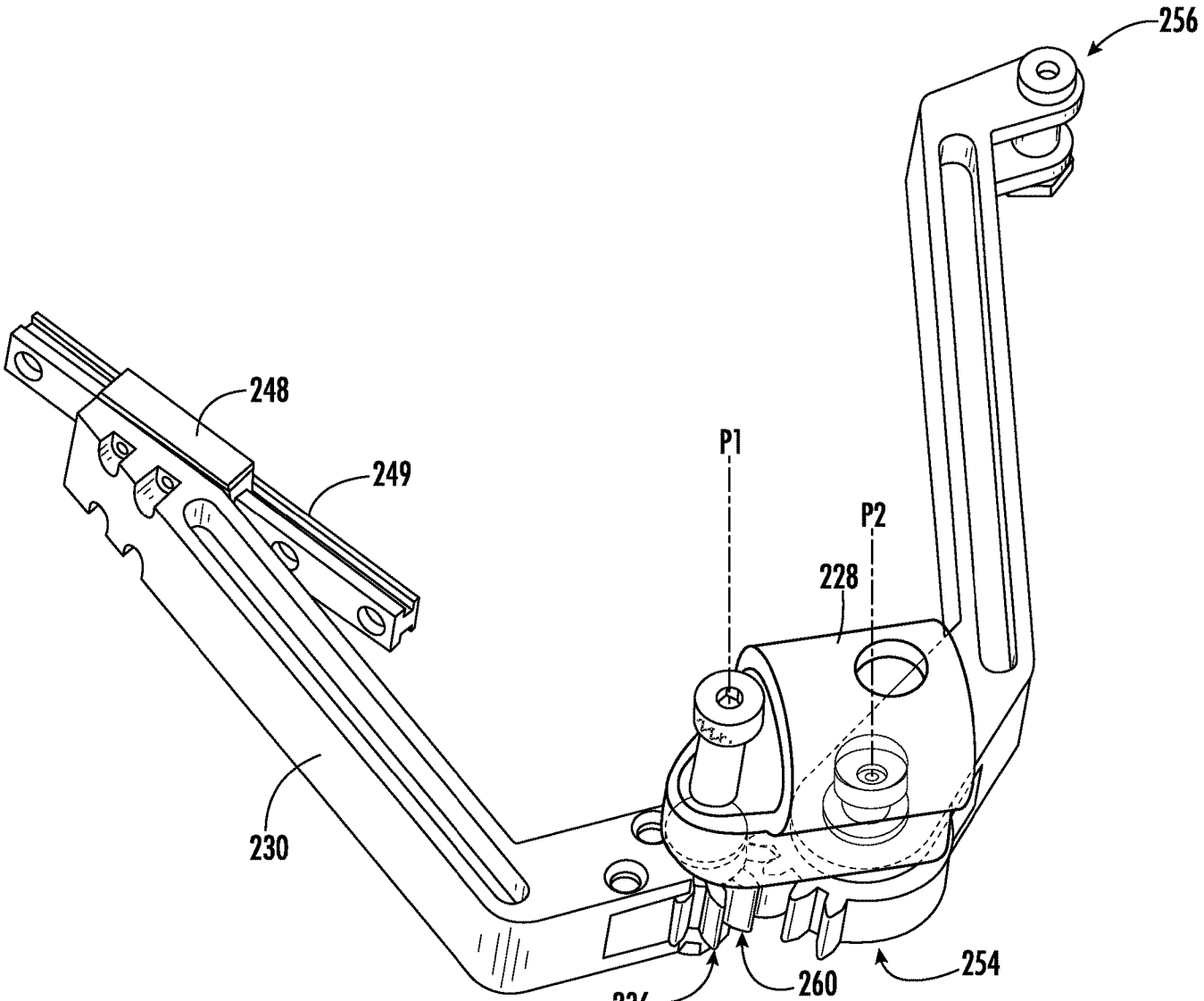
FIG. 12 provides a side perspective view of a portion of a linear hinge assembly of a refrigerator appliance according to exemplary embodiments of the present disclosure, wherein a door is in a closed position.

Referring generally to FIGS. 1 through 12, linear hinge assemblies 200 will be described in more detail according to exemplary embodiments of the present disclosure. Specifically, FIGS. 1 and 3 illustrate a linear hinge assembly 200 in a closed position. FIGS. 2 and 4 illustrate the same embodiment of linear hinge assembly 200 in an open position, while FIGS. 5 through 7 illustrate various portions of the same embodiment. FIG. 8 illustrates further exemplary embodiments of linear hinge assembly. FIGS. 9 and 10 illustrate other exemplary embodiments of linear hinge assembly. FIG. 11 illustrates a portion of still other exemplary embodiments of the present disclosure. FIG. 12 illustrates a portion of yet other exemplary embodiments of the present disclosure. As noted above, due to the similarity between the embodiments of linear hinge assemblies 200 described herein, like reference numerals will be used to refer to the same of substantially similar features between embodiments. Although only top linear hinge assemblies 200 are illustrated and described in detail, it should be appreciated that refrigerator appliance 100 may include bottom hinge assemblies that are substantially similar to the top linear hinge assemblies 200.

As illustrated, linear hinge assembly 200 includes at least one bearing assembly 210 mounted to cabinet 102. As an example, bearing assembly 210 may be fastened or otherwise suitably fixed to cabinet 102. More specifically, as illustrated, bearing assembly 210 includes a front bearing 212 and a rear bearing 214 spaced apart along a translation axis A, which may correspond to the transverse direction T of appliance 100 (or another suitable direction). Although bearing assembly 210 is illustrated as including two linear slide bearings, it should be appreciated that bearing assembly 210 may include any suitable number and type of bearing configuration, such as ball bearings, low friction sleeves, or any other suitable slide or linear shaft bearings.

An elongated shaft 220 is received within bearing assembly 210. In particular, elongated shaft 220 may slide along translation axis A on or within bearing assembly 210. Thus, for example, elongated shaft 220 may extend and retract along the translation axis A on bearing assembly 210 as door 122 opens and closes. Notably, as described below, this translation provides clearance or minimizes interference between door 122 and adjacent cabinetry or other structures. Elongated shaft 220 may be formed from any suitably rigid material or materials. For instance, elongated shaft 220 may include a rigid translation body 226 (e.g., formed from cylindrical steel bar). Additionally or alternatively, a shaft bracket 228 may be provided at a distal end portion 222 of elongated shaft 220 (e.g., in fixed attachment to rigid translation body 226). Optionally, one or more portions of elongated shaft 220 may be coated in any suitable coating, such as anodized aluminum or another suitable corrosion resistant coating.

As shown, elongated shaft 220 extends along the translation axis A between a proximal end portion 224 and the distal end portion 222. When assembled, distal end portion 222 may be cantilevered from bearing assembly 210 while proximal end portion 224 is generally positioned rearward from bearing assembly 210 (e.g., above cabinet 102). At or adjacent to the distal end portion 222, multiple pivot axes may be defined to direct movement of door 122.

Generally, distal end portion 222 of elongated shaft 220 is rotatably connected to door 122 (e.g., at shaft bracket 228). In particular, door 122 is rotatable about a door axis D offset from and translatable relative to elongated shaft 220. The door axis D may be perpendicular to the translation axis A. For example, the door axis D may be vertically oriented (e.g., parallel to the vertical direction V), and the translation axis A may be horizontally oriented.

As shown, door 122 is connected to cabinet 102 with linear hinge assembly 200 such that door 122 is translatable along the translation axis A relative to cabinet 102 and is also rotatable about the door axis D relative to cabinet 102. Door axis D itself may also be translatable (e.g., horizontally) relative to translation axis A as door 122 moves forward/rearward along translation axis A. Thus, for instance, when door 122 includes an outer panel that is flush mounted with adjacent cabinetry, linear hinge assembly 200 may translate door 122 along the translation axis A away from cabinet 102 as door 122 is rotated open about the door axis D. Translating door 122 away from cabinet 102 as door 122 rotates open notably assists with reducing interference between door 122 and adjacent cabinetry. In addition, translating door 122 away from cabinet 102 and relative to translation axis A as door 122 rotates open may also advantageously assist with limiting scraping of door 122 on a gasket (not shown) that extends between cabinet 102 and door 122 to seal the interior of cabinet 102.

As noted above, multiple (e.g., parallel) pivot axes may be defined at or adjacent to distal end portion 222 of elongated shaft 220. Elongated shaft 220, in particular, defines two or more shaft pivot axes coupled to separate linkages (e.g., via corresponding connection pins). For instance, elongated shaft 220 may define a first shaft pivot axis P1 at which a door linkage 230 is pivotally connected (e.g., via a corresponding connection pin extending along first shaft pivot axis P1) to couple door 122 to elongated shaft 220. Additionally, elongated shaft 220 may define a second shaft pivot axis P2 at which a cabinet linkage 232 is pivotally connected (e.g., via a corresponding connection pin extending along second shaft pivot axis P2) to couple cabinet 102 to elongated shaft 220.

Generally, first shaft pivot axis P1 and second shaft pivot axis P2 are perpendicular to the translation axis A. Moreover, first shaft pivot axis P1 and second shaft pivot axis P2 may be parallel to each other. As shown, first shaft pivot axis P1 and second shaft pivot axis P2 may be vertically oriented (e.g., parallel to the vertical direction V). In some embodiments, the first shaft pivot axis P1 is spaced apart from the second shaft pivot axis P2, as illustrated in FIGS. 1 through 7, 9, 10, and 12. Specifically, first shaft pivot axis P1 may be positioned apart from second shaft pivot axis P2 along the translation axis A. For instance, first shaft pivot axis P1 may be positioned forward from second shaft pivot axis P2 such that first shaft pivot axis P1 is closer to door 122 relative to the transverse direction T than second shaft pivot axis P2. In other words, first shaft pivot axis P1 may be proximal to door 122 in comparison to second shaft pivot axis P2 along the translation axis A. In alternative embodiments, first shaft pivot axis P1 and second shaft pivot axis P2 are coaxial or concentric with each other, as illustrated in FIGS. 8 and 11.

In certain embodiments, a third shaft pivot axis P3 is defined on elongated shaft 220. For instance, third shaft pivot axis P3 may be defined parallel to first shaft pivot axis P1 or second shaft pivot axis P2 (e.g., vertically oriented). In some embodiments, third shaft pivot axis P3 is defined forward from first shaft pivot axis P1 or second shaft pivot axis P2 along the translation axis A (e.g., as the forwardmost shaft pivot axis). As shown, an offset link 234 (e.g., rigid linkage bar) may pivotally connect to elongated shaft 220 at a joint 240 defining third shaft pivot axis P3 (e.g., as or including a corresponding connection pin extending along third shaft pivot axis P3) to further couple elongated shaft 220 to door 122. In some such embodiments, offset link 234 also pivotally connects to door 122 at door axis D (e.g., via a corresponding connection pin extending along door axis D). Thus, as door 122 rotates, offset link 234 may rotate about both door axis D and third shaft pivot axis P3.

As shown, door linkage 230 generally includes one or more rigid arms or gears that join elongated shaft 220 to door 122 while being pivotable about first shaft pivot axis P1. In some embodiments, door linkage 230 extends (e.g., horizontally) between a shaft end 236 proximal to distal end portion 222 of elongated shaft 220 and a guided end 238 disposed on door 122 (e.g., distal to distal end portion 222). For instance, shaft end 236 may be disposed at or adjacent to first shaft pivot axis P1. By contrast, guided end 238 may be slidably disposed along a guide path 244 defined on the door 122.

Optionally, one or more slider pins 242 (e.g., a pair of slider pins 242) may be fixed to door linkage 230 while extending (e.g., vertically) through guide path 244, which may be defined on a support bracket 246 fixed to door 122, as illustrated in FIGS. 1 through 10. Alternatively, however, a single rigid slider bar 248 may be fixed to door linkage 230 while being slidably mated to a rail 249 defining a guide path (e.g., as illustrated in FIG. 12), or another suitable sliding connection may be formed as would be understood.

When door 122 is in the closed position, guide path 244 may extend, at least in part along the lateral direction L (e.g., at a nonorthogonal angle relative thereto). Thus, opposite path ends 250, 252 of guide path 244 may be laterally spaced apart when door 122 is in the closed position. An outer end 250 of guide path 244 may be distal to door axis D while an inner end 252 of guide path 244 is proximal to door axis D (e.g., along a horizontal direction, such as the lateral direction L). In the closed position, guided end 238 of door linkage 230 (e.g., at least one slider pin 242) may be disposed at or proximal to the outer end 250. By contrast in the open position, guided end 238 (e.g., at least one slider pin 242) may be disposed at or proximal to the inner end 252. Thus, as door 122 is rotated open, guide path 244 may be rotated outward and guided end 238 may slide along guide path 244 to move the guided end 238 away from the outer end 250 and closer to the inner end 252. Similarly, as door 122 is rotated closed, guide path 244 may be rotated inward and guided end 238 may slide along guide path 244 to move the guided end 238 away from the inner end 252 and closer to the outer end 250.

In certain embodiments, door linkage 230 is arranged such that at least a portion of the rotational force of door linkage 230 about first shaft pivot axis P1 is directed to cabinet linkage 232. Specifically, shaft end 236 of door linkage 230 may be in mechanical communication with an extendable end 254 of cabinet linkage 232.

As an example, an intermediate link 258 may be provided, as shown in FIGS. 1 through 7. In some such embodiments, intermediate link 258 is movably mounted on elongated shaft 220 at a location that is between first shaft pivot axis P1 and second shaft pivot axis P2 (e.g., between P1 and P2 along or relative to translation axis A). As shown, intermediate link 258 may extend between a first cam axis C1 and a second cam axis C2, both of which may be parallel to first shaft pivot axis P1 and second shaft pivot axis P2. Moreover, intermediate link 258 may be coupled to door linkage 230 at first cam axis C1 and to cabinet linkage 232 at second cam axis C2 (e.g., via discrete corresponding connection pins). First cam axis C1 of intermediate link 258 may specifically couple to the shaft end 236 of door linkage 230 while second cam axis C2 couples to the extendable end 254 of cabinet linkage 232.

As another example, an intermediate gear set 260 may be provided, as shown in various embodiments between FIGS. 8 through 12. Specifically, intermediate gear set 260 may be enmeshed in mechanical communication between the door linkage 230 at the first shaft pivot axis P1 and the cabinet linkage 232 at the second shaft pivot axis P2. For instance, as shown in FIGS. 9, 10, and 12, mated gear teeth may be provided on the shaft end 236 of door linkage 230 and the extendable end 254 of cabinet linkage 232. Additionally or alternatively, two or more scissor gear arms may be provided with one end (e.g., arm) coupled to the coaxial first and second shaft pivot axes P1, P2 and another arm coupled to door 122 (e.g., at a separate gear axis).

Cabinet linkage 232 generally includes one or more rigid arms or gears that further join elongated shaft 220 to cabinet 102. During use, cabinet linkage 232 may specifically help transfer rotation of door 122 to linear translation of elongated shaft 220. As shown, cabinet linkage 232 may extend (e.g., horizontally) between the extendable end 254 coupled to distal end portion 222 of elongated shaft 220 and the rearward end 256 disposed on cabinet 102 (e.g., apart from distal end portion 222). For instance, extendable end 254 may be disposed at or adjacent to second shaft pivot axis P2. By contrast, rearward end 256 may be slidably or pivotally disposed on cabinet 102. In some such embodiments, such as those illustrated in FIGS. 1 through 7 and 11, cabinet linkage 232 includes multiple rigid arms pivotally coupled between extendable end 254 and rearward end 256. Rotation at second shaft pivot axis P2 (e.g., motivated at least in part by rotation of door 122) may thus motivate expansion or contract of the rigid arms depending on whether the door 122 is being opened or closed, respectively. In other embodiments, such as those illustrated in FIGS. 8 through 10 and 12 a single rigid bar is provided between extendable end 254 and rearward end 256, which may slide horizontally (e.g., parallel to the lateral direction L) along a cabinet 102 guide while rotating to permit translation of extendable end 254 relative to cabinet 102.

As door 122 is rotated open, cabinet linkage 232 may thus force elongated shaft 220 forward with extendable end 254 as rearward end 256 pivots or slides on cabinet 102. Similarly, as door 122 is rotated closed, cabinet linkage 232 may force elongated shaft 220 rearward with extendable end 254 as rearward end 256 pivots or slides in the opposite direction from the opening.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A domestic appliance comprising:

a cabinet;

a door; and a linear hinge coupling the door to the cabinet, the linear hinge comprising a bearing assembly mounted to the cabinet, an elongated shaft received within the bearing assembly such that the elongated shaft is slidable along a translation axis on the bearing assembly, the elongated shaft defining a first shaft pivot axis perpendicular to the translation axis and a second shaft pivot axis parallel to the first shaft pivot axis, a door linkage pivotally coupling the door to the elongated shaft, the door linkage being pivotally connected to the elongated shaft at the first shaft pivot axis, and a cabinet linkage pivotally coupling the cabinet to the elongated shaft, the cabinet linkage being pivotally connected to the elongated shaft at the second shaft pivot axis.

2. The domestic appliance of claim 1, wherein the first shaft pivot axis is spaced apart from the second shaft pivot axis along the translation axis.

3. The domestic appliance of claim 1, wherein the first shaft pivot axis is defined forward from the second shaft pivot axis along the translation axis.

4. The domestic appliance of claim 1, wherein the linear hinge further comprises an offset link pivotally connected to the elongated shaft at a third shaft pivot axis and to the door at a door pivot axis.

5. The domestic appliance of claim 4, wherein the third shaft pivot axis is defined forward from the first shaft pivot axis on the elongated shaft.

6. The domestic appliance of claim 1, wherein the door linkage comprises a guided end slidably disposed along a guide path defined on the door.

7. The domestic appliance of claim 1, wherein the linear hinge further comprises an intermediate link movably mounted on the elongated shaft between the first shaft pivot axis and the second shaft pivot axis, the intermediate link extending between a first cam axis and a second cam axis, the intermediate link being coupled to the door linkage at the first cam axis and coupled to the cabinet linkage at the second cam axis.

8. The domestic appliance of claim 1, wherein the linear hinge further comprises an intermediate gear set enmeshed in mechanical communication between the door linkage at the first shaft pivot axis and the cabinet linkage at the second shaft pivot axis.

9. A refrigerator appliance comprising:

a cabinet;

a door; and a linear hinge coupling the door to the cabinet, the linear hinge comprising a bearing assembly mounted to the cabinet, an elongated shaft received within the bearing assembly such that the elongated shaft is slidable along a translation axis on the bearing assembly, the elongated shaft defining a first shaft pivot axis, a second shaft pivot axis, and a third shaft pivot axis, the first shaft pivot axis being perpendicular to the translation axis, the second and third shaft pivot axes being parallel to the first shaft pivot axis, a door linkage pivotally coupling the door to the elongated shaft, the door linkage being pivotally connected to the elongated shaft at the first shaft pivot axis, a cabinet linkage pivotally coupling the cabinet to the elongated shaft, the cabinet linkage being pivotally connected to the elongated shaft at the second shaft pivot axis, and an offset link pivotally connected to the elongated shaft at the third shaft pivot axis and to the door at a door pivot axis.

10. The refrigerator appliance of claim 9, wherein the first shaft pivot axis is spaced apart from the second shaft pivot axis along the translation axis.

11. The refrigerator appliance of claim 9, wherein the first shaft pivot axis is defined forward from the second shaft pivot axis along the translation axis.

12. The refrigerator appliance of claim 9, wherein the third shaft pivot axis is defined forward from the first shaft pivot axis on the elongated shaft.

13. The refrigerator appliance of claim 9, wherein the door linkage comprises a guided end slidably disposed along a guide path defined on the door.

14. The refrigerator appliance of claim 9, wherein the linear hinge further comprises an intermediate link movably mounted on the elongated shaft between the first shaft pivot axis and the second shaft pivot axis, the intermediate link extending between a first cam axis and a second cam axis, the intermediate link being coupled to the door linkage at the first cam axis and coupled to the cabinet linkage at the second cam axis.

15. The refrigerator appliance of claim 9, wherein the linear hinge further comprises an intermediate gear set enmeshed in mechanical communication between the door linkage at the first shaft pivot axis and the cabinet linkage at the second shaft pivot axis.

16. A domestic appliance comprising:

a cabinet;

a door; and a linear hinge coupling the door to the cabinet, the linear hinge comprising a bearing assembly mounted to the cabinet, an elongated shaft received within the bearing assembly such that the elongated shaft is slidable along a translation axis on the bearing assembly, the elongated shaft defining a first shaft pivot axis perpendicular to the translation axis and a second shaft pivot axis parallel to the first shaft pivot axis, a door linkage pivotally coupling the door to the elongated shaft, the door linkage being pivotally connected to the elongated shaft at the first shaft pivot axis, a cabinet linkage pivotally coupling the cabinet to the elongated shaft, the cabinet linkage being pivotally connected to the elongated shaft at the second shaft pivot axis, a guided end slidably disposed along a guide path defined on the door, and an intermediate link movably mounted on the elongated shaft between the first shaft pivot axis and the second shaft pivot axis, the intermediate link extending between a first cam axis and a second cam axis, the intermediate link being coupled to the door linkage at the first cam axis and coupled to the cabinet linkage at the second cam axis.

17. The domestic appliance of claim 16, wherein the first shaft pivot axis is spaced apart from the second shaft pivot axis along the translation axis.

18. The domestic appliance of claim 16, wherein the first shaft pivot axis is defined forward from the second shaft pivot axis along the translation axis.

19. The domestic appliance of claim 16, wherein the linear hinge further comprises an offset link pivotally connected to the elongated shaft at a third shaft pivot axis and to the door at a door pivot axis, wherein the third shaft pivot axis is defined forward from the first shaft pivot axis on the elongated shaft.

20. The domestic appliance of claim 16, wherein the linear hinge further comprises an intermediate gear set enmeshed in mechanical communication between the door linkage at the first shaft pivot axis and the cabinet linkage at the second shaft pivot axis.

* * * * *